US009902609B2

(12) United States Patent
Khambete

(10) Patent No.: US 9,902,609 B2
(45) Date of Patent: Feb. 27, 2018

(54) CUSHION STRUCTURE AND CONSTRUCTION

(71) Applicant: IndraTech LLC, Auburn Hills, MI (US)

(72) Inventor: Surendra Khambete, West Bloomfield, MI (US)

(73) Assignee: INDRATECH, LLC, Troy, MI (US)

( * ) Notice: Subject to any disclaimer, the term of this patent is extended or adjusted under 35 U.S.C. 154(b) by 588 days.

(21) Appl. No.: 14/332,539

(22) Filed: Jul. 16, 2014

(65) Prior Publication Data

US 2015/0020316 A1 Jan. 22, 2015

Related U.S. Application Data

(60) Provisional application No. 61/856,381, filed on Jul. 19, 2013.

(51) Int. Cl.

| | |
|---|---|
| ***B68G 13/04*** | (2006.01) |
| ***A47C 27/12*** | (2006.01) |
| ***B68G 11/03*** | (2006.01) |

(52) U.S. Cl.

CPC ..... *B68G 13/04* (2013.01); *A47C 27/12* (2013.01); *B68G 11/03* (2013.01)

(58) Field of Classification Search

CPC ..... A47C 27/15; A47C 27/16; A47C 27/22; A47C 16/00; A47C 27/12; A47C 27/121; A47C 27/127; A47C 31/02; A47C 31/026; A47C 27/002

See application file for complete search history.

(56) References Cited

U.S. PATENT DOCUMENTS

| | | | | | |
|---|---|---|---|---|---|
| 123,628 | A | * | 2/1872 | Haley | A47C 31/026 5/696 |
| 1,243,267 | A | * | 10/1917 | Dallavalle | A47C 31/026 5/696 |
| 1,491,458 | A | * | 4/1924 | Bednarek | A47C 27/002 5/696 |
| 1,647,222 | A | * | 11/1927 | Gillette | A47C 31/026 5/696 |
| 2,013,528 | A | * | 9/1935 | Thiele | A47C 31/026 24/102 T |
| 2,016,157 | A | * | 10/1935 | Rosberger | A47C 31/026 24/102 T |

(Continued)

OTHER PUBLICATIONS

Introduction to the Physical Properties of Flexible Polyurethane Foams for Furniture Applications, 2000 Polyurethane Foam Association, Inc.

(Continued)

*Primary Examiner* — Eric J Kurilla

(74) *Attorney, Agent, or Firm* — Carlson, Gaskey & Olds, P.C.

(57) ABSTRACT

One exemplary aspect of the present disclosure relates to, among other things, a tunable cushion including a core made of a polymer material, and at least one topper layer adjacent the core, which is also made of a polymer material. Further, the core and the at least one topper layer provide a cushion assembly having a support factor of less than or equal to 4 with an Indentation Load Deflection (ILD) determined using a 4 inch batt sample of the cushion assembly.

11 Claims, 3 Drawing Sheets

(56) References Cited

U.S. PATENT DOCUMENTS 2,159,213 A * 5/1939 Howard ..... A47C 27/22 2/268
2,233,997 A * 3/1941 Dubick ..... A47C 31/026 24/102 T
2,257,994 A * 10/1941 Zofnass ..... A47C 27/0456 5/696
2,284,274 A * 5/1942 Fridolph ..... A47C 31/026 112/475.15
2,403,043 A 7/1946 Bowersox
3,283,346 A * 11/1966 Marsh ..... A47C 27/22 156/216
3,335,435 A 8/1967 Marsh et al.
3,608,157 A * 9/1971 Molt ..... B68G 7/08 223/102
3,638,255 A * 2/1972 Sterrett ..... A47C 7/021 297/180.1
3,701,174 A * 10/1972 Randolph ..... B68G 7/08 24/102 T
3,837,020 A * 9/1974 Bosch ..... A47C 21/026 5/411
3,900,648 A * 8/1975 Smith ..... A47C 27/22 428/317.9
4,207,636 A 6/1980 Ceriani
4,618,531 A 10/1986 Marcus
4,748,768 A * 6/1988 Jacobsen ..... A01K 1/0157 5/740
4,940,502 A 7/1990 Marcus et al.
5,160,785 A * 11/1992 Davidson, Jr. ..... A47C 27/146 297/DIG. 1
5,169,580 A 12/1992 Marcus
5,272,000 A 12/1993 Chenoweth et al.
5,294,392 A 3/1994 Marcus et al.
5,552,205 A 9/1996 Lea et al.
6,155,647 A 12/2000 Albecker et al.
7,166,547 B2 1/2007 Tilton et al.
7,216,936 B2 5/2007 Peterson
7,238,633 B1 * 7/2007 Kaylor ..... A47C 27/121 442/218
7,625,629 B2 12/2009 Takaoka
7,993,734 B2 8/2011 Takaoka
2005/0076447 A1 * 4/2005 Berrocal ..... A47C 31/026 5/716
2005/0108822 A1 * 5/2005 Wu ..... A47C 7/021 5/630
2006/0175883 A1 8/2006 Neustat
2007/0293113 A1 12/2007 Ogle
2010/0287708 A1 * 11/2010 Shelby ..... A47C 27/002 5/737
2012/0284926 A1 * 11/2012 Tyree ..... A47C 27/05 5/691

OTHER PUBLICATIONS

Moonshadow Elite plush ployester wrapped foam futon, Otis Bed Manufacturing, http://www.otisbed.com/moonshadow.php.

* cited by examiner

CUSHION STRUCTURE AND CONSTRUCTION

RELATED APPLICATIONS

This application claims the benefit of U.S. Provisional Application No. 61/856,381, filed Jul. 19, 2013, the entirety of which is herein incorporated by reference

BACKGROUND

A typical cushion assembly used in seating applications includes an aesthetic cover surrounding a soft and resilient filler material such as polyurethane foam, springs and the like. Most cushions are constructed with material which provides a desired support and comfort to the user. Polyester fiber toppers are sometimes used on top and side of the cushion assembly on which a user may sit to provide a better "hand," which is a desired feel. An additional wrap is occasionally used to provide a desired function such as to provide improved resistance against flammability. The wrapped and/or padded core structure, usually made up of polyurethane foam is inserted into an aesthetic cover. The foam core is generally the same dimensions as the cover or very slightly larger than the cover.

The feel of foam cushions is very customizable. This is done by changing the foam chemistry for a given density. One measurement of "feel" for a cushion is the Indentation Load Deflection, ILD, which is determined using industry guidelines. The ILD is the amount of pounds (measured as resistant force) required to compress a 4 inch thick, 15 inch×15 inch sample to 3 inches (or 25% of original height). For example, a typical 4 inch tall polyurethane foam cushion having a density (in pounds per cubic foot, or "pcf") of 1.0 pcf has an ILD of 30.

In addition due to processing and chemistry changes this is tunable within a range of 10-40 ILD; a density of 1.2 pcf is tunable to 20-50 ILD; and so on.

A given foam cushion must also exhibit an acceptable comfort or "support factor," typically in the range of 1.7-4.0. The support factor calculated by dividing the force required to compress a 4" thick sample to 65% of its height by the force required to compress to 25% of its height; i.e. comfort factor=(ILD @65%)/(ILD @25%). In addition to comfort, a standard foam cushion must survive industry durability tests over several thousand cycles during which the foam cushion must substantially maintain its height and shape while maintaining the support factor. Polyurethane foam cushions are highly tunable in that a foam material can be easily selected to provide a desired density, ILD and support factor, which in turn provides the durability for a given application. For polyester fiber cushions, the ILD is very closely tied to the density and such fiber cushions are not easily tuned to provide both comfort and durability. To provide better durability fiber cushions must be made very dense but that is generally not acceptable as comfortable for the end user. It should be understood that while ILD is mentioned relative to foam, that ILD tests apply outside the world of foam, and can be applied to batts made of any type of material (including polymer batts).

Foam is generally very resilient and tunable but the chemistry is such that in its native state it is very highly flammable, further the process of making foam is considered harmful to the environment. Several attempts to replace foam with polyester fiber have resulted in different formed, thermo-bonded or loose fiber constructions, but none have been able to achieve desired comfort and performance sufficient for broad commercial viability due to the difficulty in tuning. Loose fibers or thermo-bonded fibers are sometimes used in outdoor cushion applications to provide improved long-term resiliency over foam. The fibers are loosely arranged relative to one another in an unconnected fashion, permitting the fibers to shift uninhibited within the cover. Such outdoor cushions are not very durable and as such not suitable for conventional seating and bedding applications.

Tufting has been used to secure multiple layers to one another or provide an aesthetically pleasing exterior cover. Often, the tufts are visible through the cover. For example, tufting is used in futons to secure the multiple layers to one another and the exterior cover. The exterior cover is arranged rather loosely about the layers.

SUMMARY

One exemplary aspect of the present disclosure relates to, among other things, a tunable cushion including a core made of a polymer material, and at least one topper layer adjacent the core, which is also made of a polymer material. Further, the core and the at least one topper layer provide a cushion assembly having a support factor of less than or equal to 4 with an Indentation Load Deflection (ILD) determined using a 4 inch batt sample of the cushion assembly.

These and other features of the disclosure can be best understood from the following specification and drawings, the following of which is a brief description.

DETAILED DESCRIPTION

Figure 1:
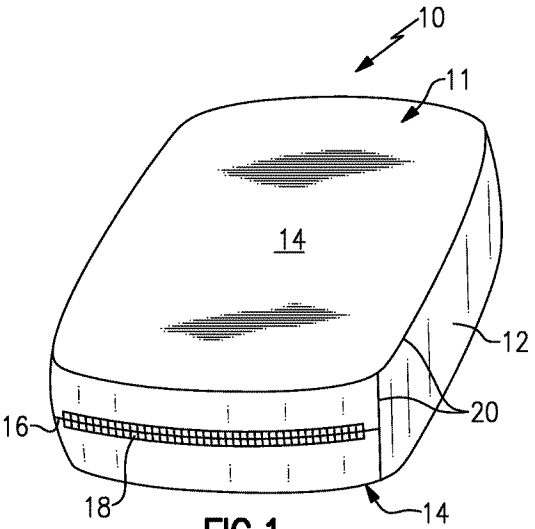
FIG. 1 is a perspective view of an example cushion assembly.

A cushion assembly 10 is schematically illustrated in FIG. 1. Initially, while the term "cushion" is used herein, this term is not meant to be limited to any particular type of cushion assembly. In particular, the term "cushion" as used herein includes both seating and sleeping pads, such as mattresses.

The cushion assembly 10 includes a cover 11 having a perimeter panel 12 joined to opposing cover panels 14 at edge 20. Typically, the perimeter and cover panels 12, 14 are sewed to one another at the adjoining edges 20 using a welting. A closure 18, such as a zipper, edge tape or hook-and-loop fastener, is provided at a seam 16 to permit insertion of a cushion into a cavity provided within the cover 11.

Figure 2:
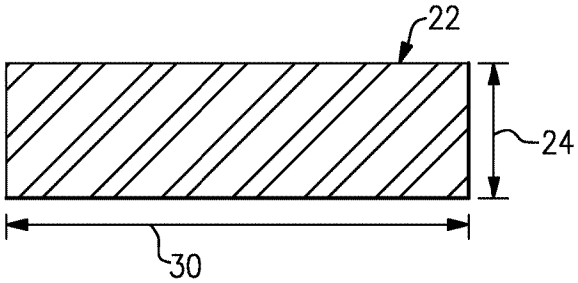
FIG.2 Prior Art
FIG. 2 is a cross-sectional view of a prior art foam cushion at a manufactured height.

FIG. 2 schematically illustrates a typical foam cushion 22 having a width 30 and a design height 24. The design height 24 generally corresponds to the height of the perimeter panel 12 for the cover into which the foam cushion 22 will be inserted. The foam cushion 22 is generally the same dimensions as the cover into which it is inserted or very slightly larger than the cover. For example, a 4 inch, 1.4 pcf density foam cushion may be manufactured for a 4 inch finished cushion assembly height. As a result, the finished cushion assembly is virtually the identical shape and size, and perhaps slightly larger, as the manufactured dimensions of the foam cushion 22.

Figure 3B:
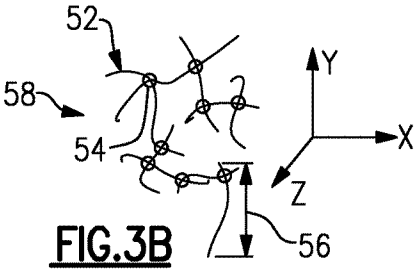
FIG. 3B is a schematic view of the randomly oriented fibers interlinked to one another with binder material.
Figure 3A:
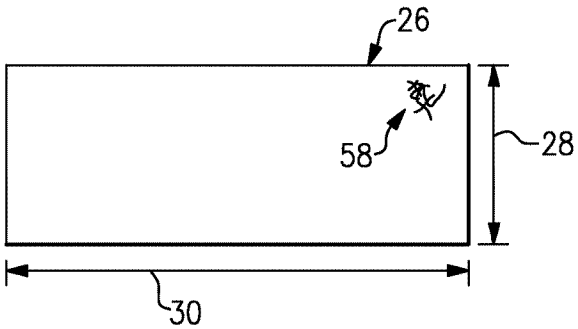
FIG. 3A is a side elevational view of a randomly oriented fiber cushion having a manufactured height for the same cushion application as the foam cushion illustrated in FIG. 2.

A manufactured fiber cushion 26 is illustrated in FIG. 3A. The manufactured fiber cushion 26 is constructed from a single layer of randomly oriented polyester staple fibers interlinked to one another using a binder material, which is elastomeric in one example. In one example, the staple fiber and binder material are the same, and are both polymer materials. The manufactured fiber cushion 26 includes a manufactured height 28 that is greater than a desired design finished height of the cushion 24. For example, if a finished height of 4 inches is desired, the manufactured fiber cushion 26 may be manufactured with 1.0 pcf of polyester fibers at a 5.6 inch height. The binder material is heated to a melting temperature to secure the staple fibers to one another once the melted binder material has solidified and produce a non-layered core batt. The core is compressed during its manufacture to provide a desired density, which is also affected by the staple and binder materials selected. The interlinked randomly oriented staple fibers 58 are shown schematically in more detail in FIG. 3B.

The staple fibers 52 include a fiber length 56 that is distributed in all three dimensions (x, y, z). In one example, the average fiber length 56 is approximately 2.5 inches. The manufactured height 28 is greater than the fiber length 56, which enables the fibers to be randomly distributed to the full extent of their fiber length in all three directions. This is contrasted with typical randomly oriented fiber manufacturing processes, such as cross lapping or air-laying, that orient the fibers in only two directions to form a relatively thin layer substantially less than the length of its staple fibers. Numerous cross lapped or air-layed layers are bonded in some fashion to one another to form a multi-layered fiber batt consisting of very thin layers. Fiber batts produced using an air-lay process do not make suitable cushions because they lose height over time to an unacceptable degree. The fiber batt formed according to this disclosure is typically an inch or greater in height, as opposed to the thin layers produced in air-lay processes, which are only fractions of an inch thick.

Figure 6:
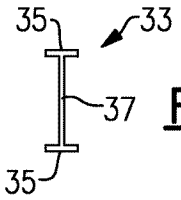
FIG. 6 is a side elevational view of an example tuft.
Figure 4:
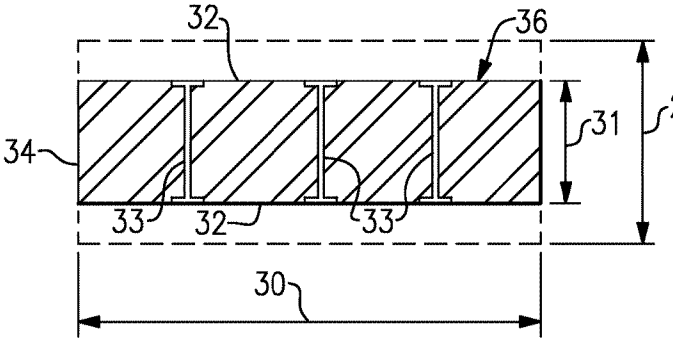
FIG. 4 is a cross-sectional view of the fiber cushion illustrated in FIG. 3A that has been tufted.

Referring to FIG. 4, the manufactured fiber cushion 26 is reduced from the manufactured height 28 to a tufted height 31 using one or more tufts 33, which may be rubber-like, for example. The tufts 33 include a body 37 extending between opposing heads 35, as illustrated in FIG. 6. The tuft 33 extends through the tufted cushion 36 to opposing surfaces 32. The width 30 of the tufted cushion 36 is generally the same as the width of the manufactured fiber cushion 26. Other tufting configurations can be used. For example, a lace and felt arrangement can be used, or a button and lace arrangement can be employed. Various tufting configurations can be used separately or in combination with one another for a given cushion assembly. The tuft 33 is not visible through the cover 11 with the cushion assembly 10 exposed and not otherwise in use. Thus, the presence of the tuft 33 is not apparent to an observer, which provides an aesthetically pleasing appearance.

The manufactured fiber cushion 26 includes a first density that is considerably less than the desired finished density of the cushion once placed within the cover. The cushion height is reduced from the manufactured height 28 to the tufted height 31, at least 5%, and in one example at least 10%, which increases the density from the manufactured fiber cushion 26 to the tufted cushion 36 at least 10%. In one example, if the desired finished height of the cushion within the cover is approximately 4 inches, the manufactured height 28 may be 5.6 inches, which when tufted and stuffed into a 4 inch high cover assembly 10 provides the comfort and resiliency of 1.4 pcf cushion that could not otherwise be provided by a 1.4 pcf cushion manufactured at a 4 inch height. Thus, the cushion will be reduced in height approximately 28%. In one example, the density is increased 40%. The example density of the manufactured fiber cushion 26 is 1.0 pcf for the 5.6 inch manufactured height.

Figure 5:
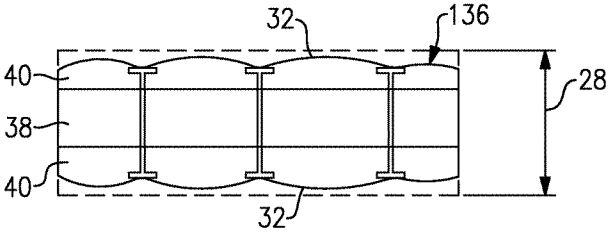
FIG. 5 is a cross-sectional view of a cushion having topper layers.

An example tufted cushion 136 is illustrated in FIG. 5. The tufted cushion 136 includes a core 38 and topper layers 40 arranged on either side of the core 38 that are tufted together as an assembly. In one example, both the core 38 and the topper layers 40 are manufactured of three dimensionally randomly oriented polyester fiber interlinked with one another as described above. In other examples, as will be explained below, the core 38 and topper layers 40 may be provided by a material other than randomly oriented polyester fibers. The tufts extend through the core 38 and the topper layers 40. Other methods of attaching the core 38 and topper layers 40 can be used such as adhesive. The topper layers 40 may be constructed separately from the core 38, for example. Each topper layer is compressed during its manufacture to provide a desired density, which is also affected by the staple and binder materials selected. The topper layers 40 are of a lower density and different fiber blend than the core 38 to provide a desired hand and performance.

Figure 7:
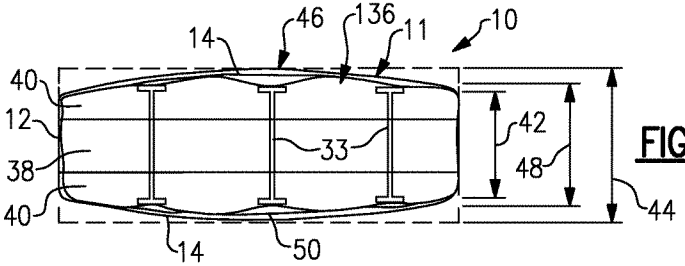
FIG. 7 is a cross-sectional view of the cushion illustrated in FIG. 5 with a wrap and inserted into a cover.
Figure 8:
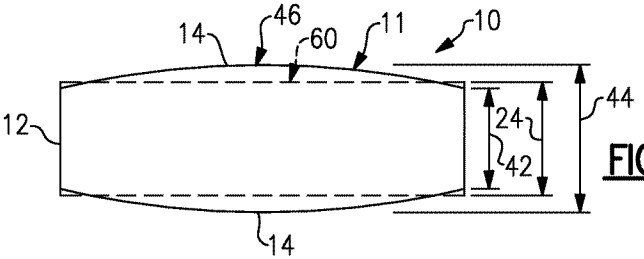
FIG. 8 is a side elevational view of a cushion assembly according to the disclosure compared to a cushion assembly using the foam illustrated in FIG. 2 for the same cushion application.

Referring to FIG. 7, the tufted cushion assembly 136 can be enclosed in a wrap 50, which provides functions like desired flammability properties and/or hand, for example. The wrap 50 is arranged around the exterior surfaces of the tufted cushion 36, including the tufts 33 and provides an actual height 48 of the tufted cushion assembly 136. A perimeter height 42 is defined by the height of the perimeter panel 12. The perimeter height 42 is approximately 90-98% of the actual or desired design height 24. The cover panels 14 provide a desired design height 44 (which should be very close to 24 and is determined by the cushion designer) and includes a crown or apex 46. The cover gradually increases to a location central to the cover 11 to provide the apex. The desired design height 44 is greater than the perimeter height 42, and in one example at least approximately 120% of the perimeter height 42 at the apex 46. The cushion assembly 10 has a crowned surface or apex 46, whereas a cushion assembly using a foam cushion has a generally flat or a nominal crown surface 60, illustrated in FIG. 8.

The disclosed cushion assembly and batt having randomly oriented staple fibers interlinked to one another using a binder material is constructed with the following specifications:

CORE:

density at manufactured height: 0.8-5.0 pcf, in one example approximately 2.8 pcf manufactured thickness of 1.0-6.0 inch 20-90 ILD

TOPPER:

density at manufactured height: 0.6-2.0 pcf manufactured thickness of 0.5-4.0 inch 10-55 ILD CUSHION ASSEMBLY (core and at least one topper layer):

density at desired design height, tufted: 1.0-3.0 pcf, in one example, approximately 1.4 pcf support factor: ≤4, with the ILD determined using a 4 inch thick sample at installed height, tufted The performance of the batt can be increased by using more binder and a higher denier fiber. Decreasing the amount of binder and using lower denier fiber decreases performance and cost. The binder and staple fibers for each layer are selected to obtain the desired ILD for each layer in order to "tune" the overall cushion assembly. In one example, a tunable fiber cushion includes a batt of randomly oriented first polyester fibers interlinked with a first binder material. The batt has a non-layered core with a first manufactured height defined by opposing surfaces and that includes a first density. The first density is 0.8-5.0 pcf. At least one topper layer of randomly oriented second polyester fibers is interlinked with a second binder material. A topper layer includes a second manufactured height of a second density. The topper layer is arranged on a side adjacent to one opposing surface. The second density is 0.6-1.4 pcf. A tuft extends through the batt and the topper layer to provide a tufted cushion assembly having a tufted height and a third density at the tufted height that is greater than the first density or the second density. The third density is 1.0-3.0 pcf. The tufted cushion assembly at the tufted height provides a support factor of less than or equal to 4 with an ILD and is determined using a 4 inch batt sample of the batt at the tufted height.

Figure 9:
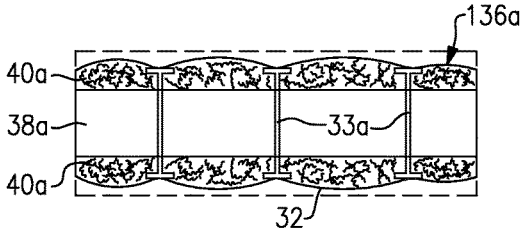
FIG. 9 is a cross-sectional view a cushion having three-dimensional netted topper layers.
Figure 10A:
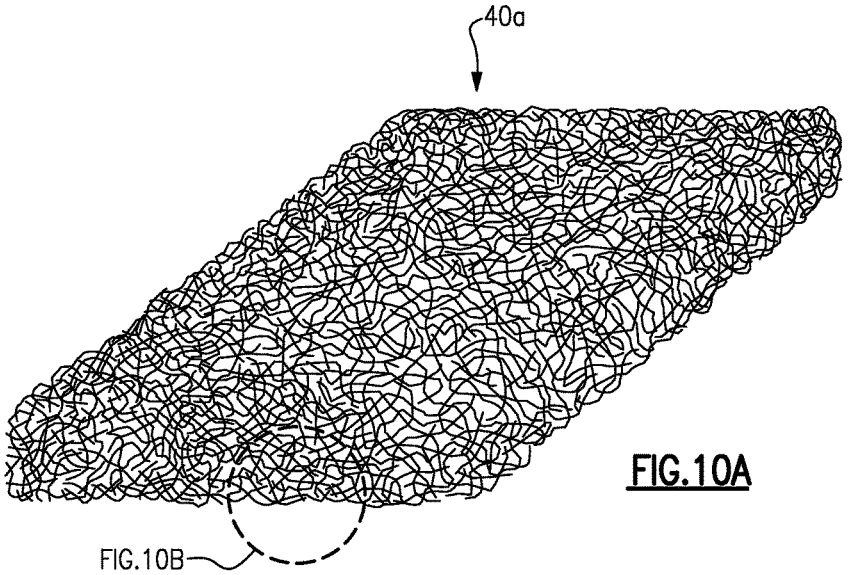
FIG. 10A is a view of a batt of material used to provide the topper layers of FIG. 9.
Figure 10B:
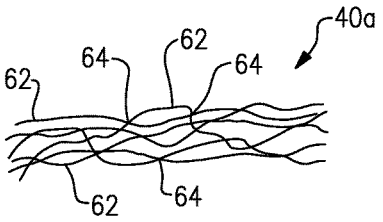
FIG. 10B is a close-up view illustrating the detail of the resin filaments in FIG. 10A.

In a further embodiment of this disclosure, a cushion 136*a* includes a netted topper layer 40*a* provided by a three-dimensional netted material, as illustrated in FIG. 9, in place of the randomly oriented polyester topper layer 40 illustrated of FIGS. 5 and 7. As illustrated in FIG. 10B, the netted layer 40*a* is made of a plurality of helically arranged thermoplastic resin filaments 62 partially thermally bonded to at least one of the other thermoplastic resin filaments, such as at points 64. In this way, the thermoplastic resin filaments 62 are randomly entangled with one another, and provide a layer, such as the netted layer 40*a* of FIG. 10A. The random entangling of the resin filaments 62 provides substantial spacing, or gaps, between the filaments, which in turn provides the netted layer 40*a* with increased breathability without compromising qualities such as resiliency, fire-resistance, and the overall performance of the cushion.

An example of the netted layer 40*a* is disclosed in U.S. Pat. Nos. 7,625,629 and 7,993,734 to Takaoka, the entirety of which are herein incorporated by reference. The Takaoka patents describe example methods for making the netted material, as well as describe various embodiments of the netted material. As mentioned, the netted material made from the methods disclosed in the Takaoka patents are relatively lightweight and breathable, but still provide a high level of support. The method for making the netted material can be modified to provide a batt of a desired density. Modifying the density of the netted layer 40*a* allows one to "tune" the overall cushion assembly.

In the cushion 136*a* shown in FIG. 9, the netted layers 40*a* are provided on opposing sides of the batt 38, and the overall assembly provides a support factor of less than or equal to 4 with an ILD determined using a 4 inch thick sample. While two netted layers 40*a* are illustrated in FIG. 9, another example of the cushion 136*a* includes only one layer of netted layer 40*a* (e.g., only a top layer), and the thickness of that single netted layer 40*a* is also provided such that the assembly exhibits a support factor of less than or equal to 4 with the ILD determined using a 4 inch thick sample.

In yet another example, the cushion 136*a* may include a batt 38*a* provided by a layer of three-dimensional netted material, and topper layers 40*a* provided by randomly oriented polyester fibers. In still another example, the cushion 136*a* may include a batt 38*a* and one or more topper layers 40*a* provided by separate layers of three-dimensional netted material. In this case, the density of the three-dimensional netted material providing the batt 38*a* would be higher than the density of the three-dimensional netted material providing the topper layers 40*a*. In any of these arrangements, the cushion 136*a* exhibits a support factor of less than or equal to 4 with the ILD determined using a 4 inch thick sample. While a tufted assembly is illustrated in FIG. 9 (e.g., see tufts 33*a*), it should be understood that the layers may be joined together in other ways, such as by using an adhesive.

The cushion 136*a* is thus tunable and provides an acceptable "feel" to a user, just as the cushion of FIGS. 3A-8 does. The cushion 136*a* further maintains its shape and elasticity over time by minimizing the exposure of the batt (or core) 38*a* to the body heat of a user, for example.

Although example embodiments have been disclosed, a worker of ordinary skill in this art would recognize that certain modifications would come within the scope of the claims. For that reason, the following claims should be studied to determine their true scope and content.

What is claimed is:

1. A tunable cushion comprising:

a core made of a polymer material;

at least one topper layer adjacent the core, wherein the at least one topper layer is provided by a three-dimensional netted layer consisting of a plurality of helically arranged thermoplastic resin filaments, each of the thermoplastic resin filaments being partially thermally bonded directly to at least one of the other thermoplastic resin filaments such that the thermoplastic resin filaments are randomly entangled with one another;

wherein the core and the at least one topper layer provide a cushion assembly having a support factor of less than or equal to 4 with an Indentation Load Deflection (ILD) determined using a 4 inch batt sample of the cushion assembly.

2. The tunable cushion as recited in claim 1, wherein the core is provided by one of (1) randomly oriented polyester fibers interlinked with a polyester binder material and (2) a three-dimensional netted layer of a plurality of helically arranged thermoplastic resin filaments, each of the thermoplastic resin filaments being partially thermally bonded to at least one of the other thermoplastic resin filaments such that the thermoplastic resin filaments are randomly entangled with one another.

3. The tunable cushion as recited in claim 1, including a tuft extending through the core and the at least one topper layer to provide a tufted cushion assembly having a tufted height and a density within a range of 1.0-3.0 pounds per cubic foot (pcf).

4. The tunable cushion as recited in claim 3, wherein the tufted cushion assembly at the tufted height provides a support factor of less than or equal to 4 with an ILD determined using a 4 inch thick sample of the tufted cushion assembly at the tufted height.

5. The tunable cushion as recited in claim 1, wherein the at least one topper layer includes two topper layers positioned on respective opposing surfaces of the core.

6. The tunable cushion as recited in claim 5, wherein each of the two topper layers are each provided by a three-dimensional netted layer consisting of a plurality of helically arranged thermoplastic resin filaments, each of the thermoplastic resin filaments being partially thermally bonded directly to at least one of the other thermoplastic resin filaments such that the thermoplastic resin filaments are randomly entangled with one another.

7. The tunable cushion as recited in claim 6, wherein the core is provided by randomly oriented polymer fibers interlinked with a polymer binder material.

8. The tunable cushion as recited in claim 1, wherein the tunable cushion is wholly polymer.

9. A tunable cushion comprising:

a core made of randomly oriented polymer fibers interlinked with a polymer binder material;

a first topper layer adjacent a first side of the core;

a second topper layer adjacent a second side of the core opposite the first side, the first and second topper layers each provided by a three-dimensional netted layer consisting of a plurality of helically arranged thermoplastic resin filaments, each of the thermoplastic resin filaments being partially thermally bonded directly to at least one of the other thermoplastic resin filaments such that the thermoplastic resin filaments are randomly entangled with one another;

a tuft extending through the core and the first and second topper layers to provide a tufted cushion assembly having a tufted height and a density within a range of 1.0-3.0 pounds per cubic foot (pcf); and wherein the tufted cushion assembly has a support factor of less than or equal to 4 with an Indentation Load Deflection (ILD) determined using a 4 inch batt sample of the tufted cushion assembly at the tufted height.

10. The tunable cushion as recited in claim 9, wherein the tunable cushion is wholly polymer.

11. The tunable cushion as recited in claim 9, including a cover having perimeter panels providing a perimeter height and spaced apart cover panels extending between the perimeter panels, the perimeter and cover panels providing a cushion cavity, the tunable cushion provided within the cushion cavity.

* * * * *